United States Patent [19]

Thompson et al.

[11] Patent Number: 4,580,888

[45] Date of Patent: Apr. 8, 1986

[54] ELECTROSTATOGRAPHIC DEVELOPMENT APPARATUS

[75] Inventors: Philip R. Thompson, Harpenden; Tony Church, Luton, both of England

[73] Assignee: Xerox Corporation, Stamford, Conn.

[21] Appl. No.: 613,482

[22] Filed: May 24, 1984

[30] Foreign Application Priority Data

Jun. 8, 1983 [GB] United Kingdom ..... 8315726

[51] Int. Cl.[4] ..... G03G 15/09

[52] U.S. Cl. ..... 355/3 DD; 222/DIG. 1

[58] Field of Search ..... 355/3 DD, 3 R; 277/80; 222/DIG. 1; 118/656, 657, 658

[56] References Cited

U.S. PATENT DOCUMENTS

| | | | |
|---|---|---|---|
| 3,651,784 | 3/1972 | Hewitt | 355/3 DD |
| 3,788,275 | 1/1974 | Hanson | 118/637 |
| 3,924,944 | 12/1975 | Smith et al. | 355/3 DD |
| 4,449,810 | 5/1984 | Ikesue et al. | 355/3 DD |
| 4,457,257 | 7/1984 | Murakami et al. | 355/15 |
| 4,466,728 | 8/1984 | Schlageter et al. | 355/3 DD |

FOREIGN PATENT DOCUMENTS

| | | | |
|---|---|---|---|
| 0149962 | 11/1980 | Japan | 355/3 DD |

*Primary Examiner*—A. T. Grimley
*Assistant Examiner*—David I. Warren
*Attorney, Agent, or Firm*—H. Fleischer; J. E. Beck; R. Zibelli

[57] ABSTRACT

An apparatus in which a latent image recorded on a photoconductive surface is developed. The apparatus has a housing which forms, with the photoconductive surface, a substantially closed volume with the sealing edges of the housing being closely spaced from the photoconductive surface. A magnetic strip is mounted on at least one of the sealing edges of the housing. The magnetic sealing strip prevents the escape of carrier granules from the housing without the carrier granules adhering thereto.

2 Claims, 3 Drawing Figures

ELECTROSTATOGRAPHIC DEVELOPMENT APPARATUS

This invention relates to an electrophotographic printing machine, and more particularly concerns an apparatus for developing a latent image having a sealing arrangement to prevent the escape of developer material therefrom.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the development system uses a two-component developer material having magnetically attractable carrier particles with toner particles adhering triboelectrically thereto. The developer material is brought into contact with the electrostatic latent image recorded on the photoconductive surface and toner particles are attracted from the carrier particles to the charged portions of the electrostatic latent image. In order to bring the developer material into contact with the latent image recorded on the photoconductive surface, a magnetic brush roll is used. A suitable magnetic brush roll has a magnetically transparent cylindrical shell mounted for rotation about a stationary set of magnets. The magnetic field lines emanating from the magnets cause the magnetically attractable carrier particles to form a brush of bristles on the cylindrical shell. As the cylindrical shell rotates, the brush of bristles continuously collapses and reforms, so that in operation, the magnetic brush roll has the effect of a rotating brush which brushes toner particles onto the photoconductive surface.

In a development system of this type, it is often difficult to contain the developer material within the housing. There must be a gap between the photoconductive surface and the edges of the developer housing abuttng the photoconductive surface to permit movement of the photoconductive surface past the magnetic brush developer roller. Clearly, the smaller the gap, the better the ability of the developer housing to contain the developer material. However, a very small gap gives rise to problems. First, the dimensional accuracy of the parts involved must be extremely high, with the resultant requirement of tight manufacturing tolerances. This adds to the cost of the system. Second, there is the problem of damage to the photoconductive surface by developer material particles being jammed between the housing edges and the photoconductive surface. Jammed developer material particles scratch the photoconductive surface. These problems may be alleviated by using a larger gap between the housing edges and the photoconductive surface. However, this increases the possibility of developer material escaping from the housing. Escaping particles can deposit on any surface within the apparatus, giving rise to problems such as dirty optics and reduced efficiency of corona generating devices.

Hereinbefore, this problem has been, at least partially, overcome by using a magnetic brush as a sealing mechanism. In this approach, a static magnetic brush is formed along the housing edge which abuts the photoconductive surface, and the bristles of the brush prevent the escape of particles from the housing. This form of seal works reasonably well in certain circumstances, but when a developer roll adjacent the sealing edge of the housing is rotating such that particles are thrown directly toward the seal, the thrown-off particles tend to disrupt the brush and allow some particles to escape from the housing.

Various approaches have been devised using a magnetic brush seal. The following disclosure appears to be relevant:

U.S. Pat. No. 3,788,275
Patentee: Hanson
Issued: Jan. 29, 1974

The pertinent portions of the foregoing disclosure may be briefly summarized as follows:

Hanson describes a magnetic ring which attracts carrier granules thereto forming a shield which prevents contamination of ball bearings on a shaft.

In accordance with one aspect of the present invention, there is provided an apparatus for developing a latent image recorded on a photoconductive surface. Means are provided for transporting a developer material comprising at least magnetic carrier granules and toner particles into contact with the latent image. Means generate a magnetic field to attract the developer material to the transporting means. Magnetic means, interacting with the generating means, produce a resultant magnetic field which seals the apparatus to prevent the escape of carrier granules therefrom without the carrier granules adhering to the magnetic means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
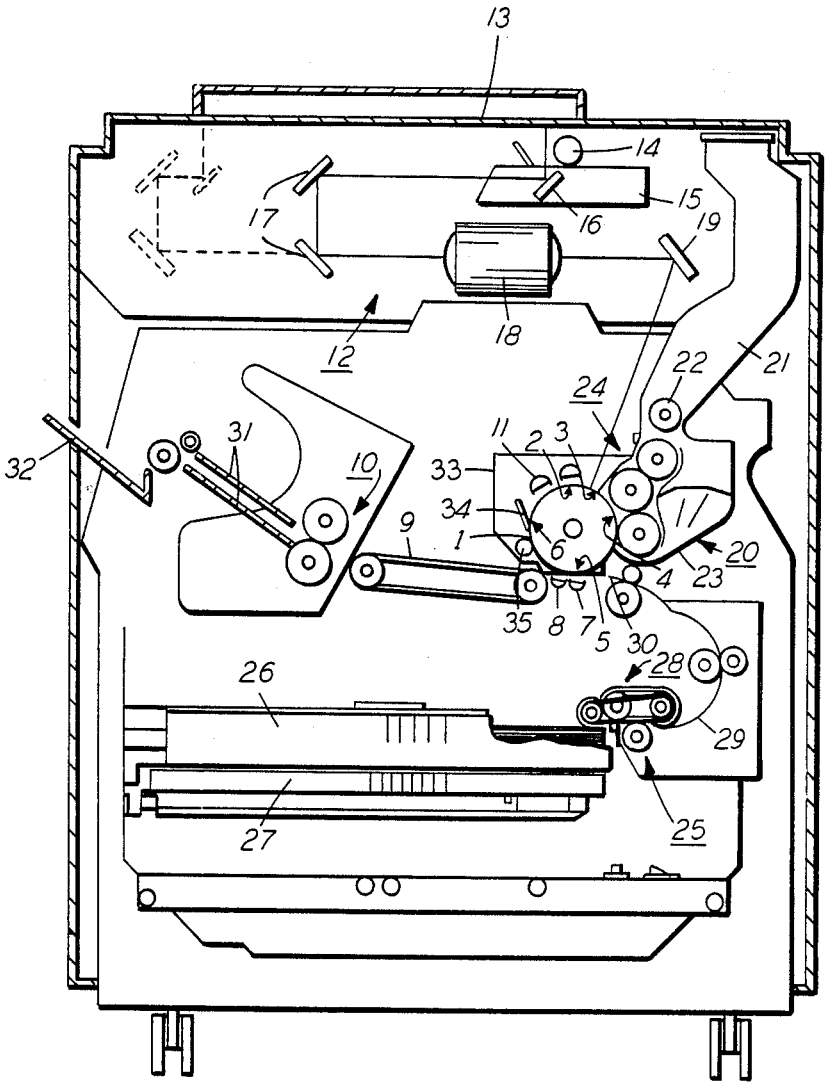
FIG. 1 is a schematic, elevational view of an electrophotographic printing machine incorporating the features of the present invention therein.

Referring now to FIG. 1, there is shown an illustrative electrophotographic printing machine having a drum 1 mounted for rotation (in the clockwise direction as viewed in FIG. 1) to advance the photoconductive surface thereof sequentially through a series of processing stations: a charging station 2; an imaging station 3; a development station 4; a transfer station 5; and a cleaning station 6.

Charging station 2 has a corona generating device which deposits a uniform electrostatic charge on the photoconductive surface. A document to be reproduced is positioned on a platen 13 and scanned by means of a moving optical scanning system to produce a flowing light image on drum 1 at 3. The optical image selectively discharges the photoconductive surface in image configuration, whereby an electrostatic latent image of the document is recorded down on the photoconductive surface. At development station 4, the electrostatic latent image is developed into visible form by bringing toner particles into contact therewith. The toner particles are deposited on the charged areas of the photoconductive surface. Cut sheets of paper are moved to transfer station 5 in synchronous relation with the developed image on the photoconductive surface. The developed image is transferred to the copy sheet thereat. A transfer corona generating device 7 generates an electric field to assist in the transfer of the toner particles to the copy sheet. The copy sheet is then stripped from drum 1. Detachment of the copy sheet from the drum is assisted by an electric field generated by a detack corona generating device 8. The copy sheet having the developed image thereon is then advanced by transport belt system 9 to fusing station 10.

After transfer of the developed image from the photoconductive surface, some toner particles usually remain thereon. These particles are removed therefrom at cleaning station 6. After cleaning, any electrostatic charges remaining on the photoconductive surface are removed by an erase corona generating device 11. The photoconductive surface is then ready to be charged again by charging corona generating device 2, as the first step in the next copy cycle.

The optical image at imaging station 3 is formed by optical system 12. A document (not shown) to be copied is placed on platen 13, and is illuminated by a lamp 14 that is mounted on a scanning carriage 15 which also carries a mirror 16. Mirror 16 is a full-rate scanning mirror of a full and half-rate scanning system. Full-rate mirror 16 reflects an image of a strip of the document to be copied onto the half-rate scanning mirror 17. The image is focused by a lens 18 onto drum 1, being deflected by a fixed mirror 19. In operation, full-rate mirror 16 and lamp 14 are moved across the machine at a constant speed, while at the same time half-rate mirrors 17 are moved in the same direction at half that speed. At the end of a scan, the mirrors are in the position shown in a broken outline at the left-hand side of FIG. 1. These movements of the mirrors maintain a constant optical path length so as to maintain the image on the photoconductive surface in sharp focus throughout the scan.

At development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and toner. The developer material is brought into contact with drum 1 by a three-roll magnetic brush developing system 24.

The developed image is transferred, at transfer station 5, from the photoconductive surface to a sheet of copy paper (not shown) which is delivered into contact therewith by paper supply system 25. Paper copy sheets are stored in two paper trays, an upper, main tray 26 and a lower, auxiliary tray 27. The top sheet of paper in either one of the trays is moved, as required, into feeding engagement with a common fixed position, sheet feeder 28. Sheet feeder 28 advances sheets around curved guide 29 for registration at a registration point 30. Once registered, the sheet is moved into contact with the photoconductive surface in synchronous relation to the image so as to receive the image at transfer station 5.

The copy sheet carrying the transferred image is transported by means of vacuum transport belt 9 to heated roll fuser 10. The image is fixed to the copy sheet by the heat and pressure in the nip between the two rolls of the fuser. The final copy is fed by the fuser rollers along output guides 31 into catch tray 32.

After transfer of the developed image from the photoconductive surface to the copy sheet, the photoconductive surface is cleaned at cleaning station 6. At the cleaning station a housing 33 forms with the drum 1 an enclosed cavity having a doctor blade 34 mounted therein. Doctor blade 34 scrapes residual toner particles off the photoconductive surface. The scraped particles fall to the bottom of the housing. Auger 35 transports the particles from the housing.

Figure 2:
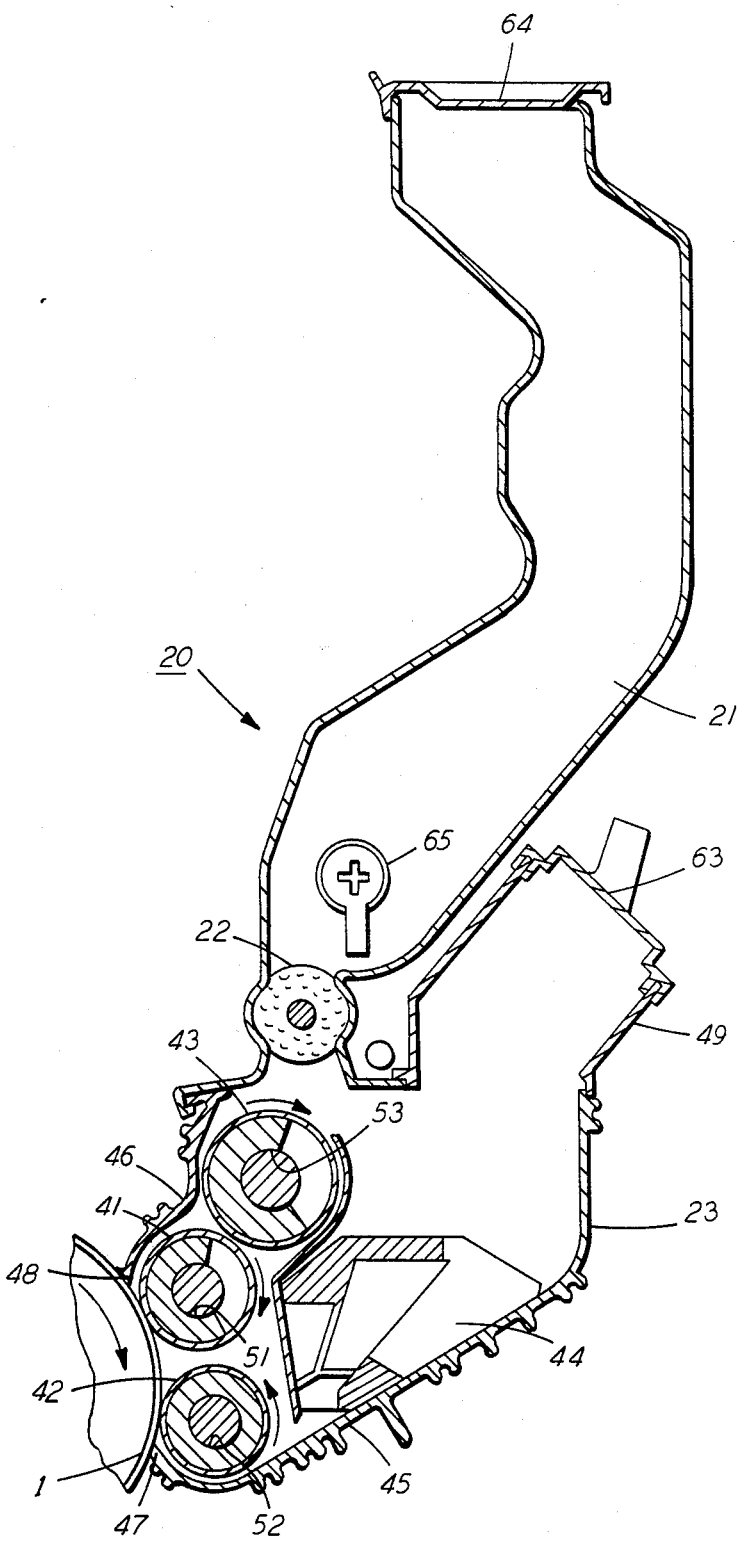
FIG. 2 is a sectional elevational view of the development apparatus used in the FIG. 1 printing machine.
Figure 3:
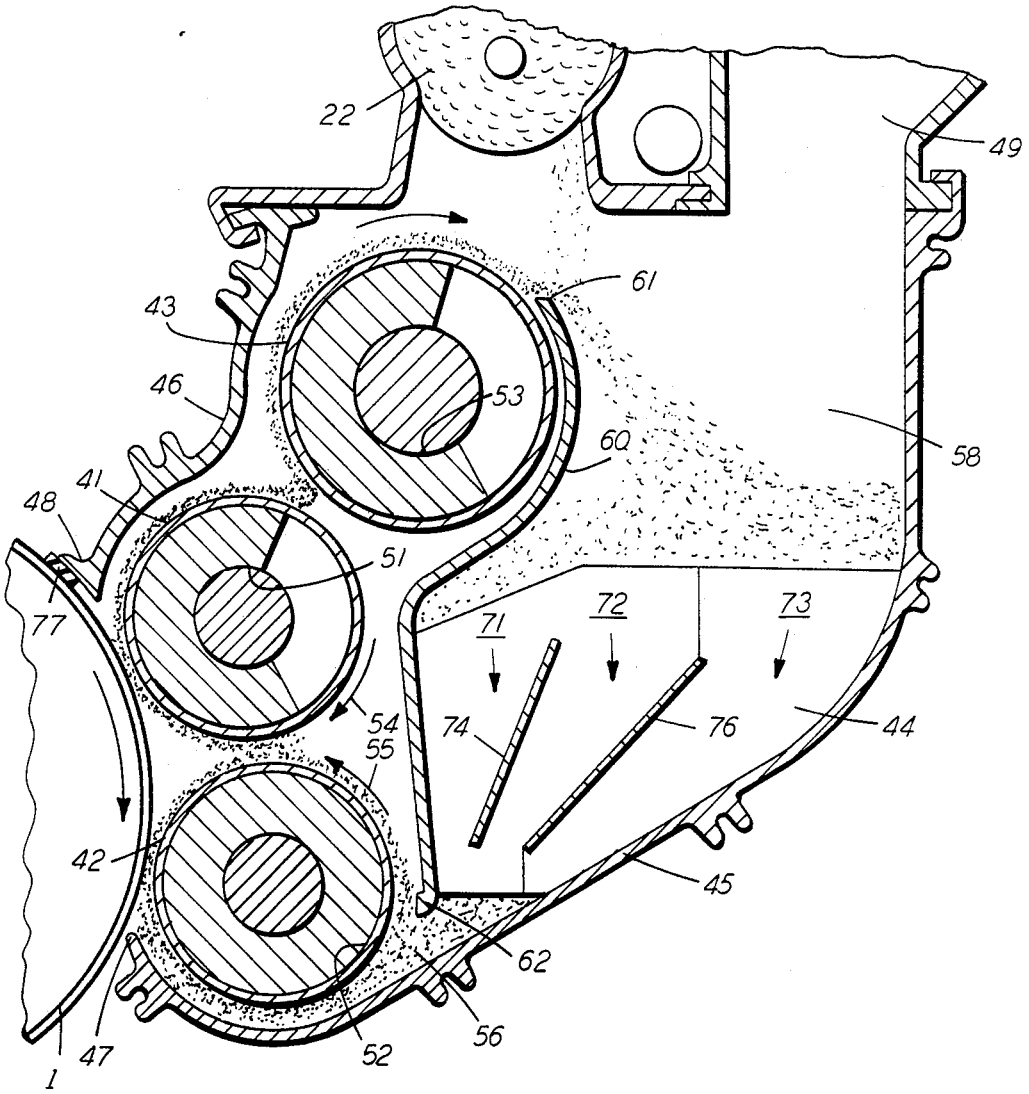
FIG. 3 is an enlarged, fragmentary, sectional, elevational view of a portion of the development apparatus shown in FIG. 2.

Referring now to FIGS. 2 and 3, development system 20 has upper and lower development rolls 41 and 42, a single transport roll 43, and a crossmixer 44. The developer mixture includes magnetizable carrier particles and toner particles. The carrier particles are recirculated within the developer housing 23 with the toner particles, some of which are consumed during development, being replenished from a supply contained in toner hopper 21 by rotating foam roller 22.

Developer housing 23 has a lower extrusion 45 and an upper extrusion 46. The left-hand extremity 47 of the lower extrusion 45, as viewed in FIG. 2, and the lower extremity 48 of the front extrusion 46 define an opening adjacent drum 1. Extrusions 45 and 46 are mounted between end plates (not shown) at the front and rear of the machine with the entire assembly forming a substantially sealed chamber. The chamber is closed at the top by toner hopper 21 and by negative pressure chamber housing 49.

Mounted within housing 23 are the three magnetic brush rollers 41, 42 and 43. Rolls 41 and 42 are the developer rolls, and roll 43, above the upper developer roll 41, is a transport roll. Rolls 41, 42 and 43 are flow formed, of extruded aluminum or aluminum alloy, tubes surrounding fixed multi-pole rubber magnets 51, 52 and 53, respectively. The magnets are held in position by flats on their respective spindles about which rolls 41, 42 and 43 rotate on their respective bearings in the end caps.

The operation of the three-roll development system will now be described in more detail with reference to FIG. 3. Upper developer roll 41 and lower developer roll 42 are mounted for rotation in opposite directions, as indicated by arrows 54 and 55. Developer material is picked up by the lower developer roll 42 in region 56 located near the bottom of the housing 23 adjacent the bottom of crossmixer 44. As indicated by the arrows in FIG. 3, developer material is carried upwards, on the portion of lower developer roll 42 which is furthest from drum 1, into the gap between lower developer roll 42 and upper developer roll 41. Upper developer 41 is rotating in the opposite direction to lower developer roll 42, so the top of the lower roll and the bottom of the upper roll are moving in the same direction, i.e. towards drum 1. The magnetic poles within stationary magnets 51 and 52 are arranged to cause splitting of the stream of developer material into substantially equal streams, one of which is carried upwards against the photoconductive surface by the upper developer roll 41, and the other of which is carried downwards thereagainst by the lower developer roll 42. During passage of the developer material over the photoconductive surface adjacent both developer rolls, development of the electrostatic latent image takes place by the deposition of some of the toner particles thereon. The developer material on the lower developer roll 42, after developing the latent image on the photoreceptor, is carried down to the bottom of housing 23, and back into region 56. There, the unused developer material joins and mixes with developer material falling from the bottom of crossmixer 44. Developer material on upper developer roll 41, after developing the latent image, is carried upwards toward transport roll 43. Transport roll 43 is mounted for rotation in the same rotational sense as upper developer roll 41. The magnetic poles in magnet 51 of upper developer roll 41 are such that the magnetic field substantially disappears in the nip between the upper developer roll 41 and the transport roll 43. This prevents developer material from entering the nip between the two rolls. Transport roll 43 carries developer material upwardly, away from drum 1, and towards the rear of housing 23. The magnetic field of magnet 53 in transport roll 43 substantially disappears just beyond the top of the transport roll 43. The developer material leaving the transport roll falls into reservoir 58 of developer material which fills crossmixer 44 at all times. A valance 60 divides the region of housing 23 containing the magnetic brush rolls from the region containing the crossmixer 44. The upper edge 61 of the valance assists in deflecting developer material into the reservoir 58 of developer material. The lower edge 62 of the valance defines a feed gap adjacent lower developer roll 42 through which passes developer material picked up by lower developer roll 42 from region 56.

As indicated in a general way in FIG. 3 by the dots representing developer material and by the accompanying arrows, the developer material is circulated around the developer housing to contact the photoconductive surface at two separate places. The first development takes place adjacent the upper developer roll 41, when the developer material is carried in a direction against the direction of movement of the drum. The second development takes place adjacent the lower developer roll 42, where the developer material is carried in the same direction as the drum.

During development, the developer material loses a certain proportion of its toner particles. Fresh toner particles are added in the upper regions of housing 23 by rotation of foam roller 22 which drops toner particles onto the carrier particles being transported by the transport roll 43 towards reservoir 58.

In order to contain developer material in housing 23, a magnetic strip seal 77 is provided along the edge of the housing formed by lower extremity 48 of front extrusion 46. A groove or ledge is provided along the edge of extremity 48 to accommodate a magnetic strip of suitable cross section, for example of rectangular or triangular cross section. The magnetic strip may be a flexible strip of a ferrite material, and the desired length of strip may be secured by adhesive into the groove or ledge in extremity 48. The magnetic poles of magnetic strip 77 are arranged so that its face adjacent to the photoconductive surface is of one polarity, that polarity being carried toward it by the upper developer roll 41. A similar magnetic strip seal (not shown) may be provided along the edge of the housing formed by the left-hand extremity 47 of the lower extrusion 45.

Without a magnetic strip seal, carrier particles carried by the upper developer roll 41, especially those being carried on the outside extremity of the magnetic brush, have a ratio of radial to tangential forces acting on them which is such that some of these are projected toward the small gap which necessarily exists between the imaging surface and the lower extremity 48 of the upper part of the housing. In the absence of anything to stop them, some of the carrier particles projected toward the gap will escape through it. The magnetic strip seal appears to modify the ratio of the radial to tangential forces acting on the carrier particles such that the carrier particles in the vicinity of the magnetic strip are all carried with the magnetic brush rather than being projected away from it. This seems to be because the magnetic field lines of the nearest pole of the magnetic brush developer roll are modified by the magnetic field of the magnetic strip so as to deflect them away from the gap. This contains the carrier particles inside the housing, without causing them to adhere magnetically to the magnetic strip.

Mounted on top of the housing 23 (FIG. 2) to the right of the toner hopper 21 is the negative pressure chamber housing 49. An outlet 63 on the top of this chamber is connected by a tube to a vacuum system which creates a small negative pressure inside the developer housing. This causes a general flow of air from the region of the drum into the housing, which prevents the emission of clouds of toner from the housing, and reduces contamination in the machine.

Toner housing 21 (FIG. 2) is a relatively tall, narrow container with a generally horizontal lid 64 in its top face. Lid 64 is accessible from the top of the machine. Housing 21 is shaped so as to fit around the right-hand part of the optical system of the machine with its lower extremity being shaped to accommodate foam roll 22. The neck of the hopper is arranged to slightly pinch the foam roller so as to assist in dislodging toner from the roller, and drop it into the housing 23. A stirrer 65 is mounted just above roller 22 to assist the flow of toner within hopper 21 to roller 22.

Crossmixer 44 is located between valance 60 and lower extension 45 of housing 23. The lowermost part of the crossmixer is adjacent the developer take-up region 56. The crossmixer has three parallel rows of chambers; a front row 71 closest to the developer rolls, a middle row 72, and a rear row 73 furthest from the developer rolls. The three rows of chambers are formed by sets of vanes projecting from dividing walls. The crossmixer is made from two component parts, which are aluminum alloy castings. The front casting 74 (nearest the developer rolls) has vanes projecting forwardly to abut valance 60 and rearwardly to abut rear casting 76, while rear casting 76 has vanes projecting only rearwardly to abut lower extension 45 of housing 23.

Each chamber in each row has an entrance aperture at the top and an exit aperture at the bottom of the crossmixer. The exit aperture in each chamber is displaced from a position vertically below the entrance aperture of that chamber. The chambers in each row are arranged with their exit apertures displaced alternately to the left and to the right of their entrance apertures. Thus, a quantity of developer material entering the entrance aperture of one of the chambers will be displaced to the left or to the right (along a direction parallel with the axes of the developer rolls), so that on recirculation by the developer rolls to the top of the crossmixer, which is a substantially vertical movement, the developer material will re-enter the top of the crossmixer displaced to the left or the right of the position where it entered on the previous passage through the crossmixer. In any one position along the crossmixer, the entrance aperture of only one chamber is available for entry of developer material, with the entrance apertures and exit apertures being arranged such that on each recirculation the next entrance aperture entered by the developer material is in different row, with the developer material displaced in the same direction as on the previous recirculation, until the end of a row is reached. The direction of displacement is then reversed, and the developer material is recirculated with displacement in the opposite direction to that just described by way of a set of chambers alternating with the first set. The crossmixer is maintained full of developer material at all times, and it will accordingly be clear that developer material is passing through all of the entrance apertures at any one time, causing simultaneous movements of developer from left to right and from row to row, and from right to left and from row to row.

In recapitulation, it is clear that the magnetic field produced by the magnetic seal interacts with the magnetic field of the developer roll to contain particles within the developer housing without the particles being attracted to the seal.

It is, therefore, evident that there has been provided in accordance with the present invention, an apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appealed claims.

We claim:

1. An apparatus for developing a latent image recorded on a photoconductive surface, including:

means for transporting a developer material comprising at least magnetic carrier granules and toner particles into contact with the latent image;

a housing defining a chamber having said transporting means disposed therein and forming with the photoconductive surface a substantially closed volume with sealing edges of said housing being closely spaced from the photoconductive surface on either side of said transporting means;

a magnetic strip mounted on one of the sealing edges of said housing; and a stationary, cylindrical magnet disposed in the chamber of said housing and having a plurality of magnetic poles spaced circumferentially around the periphery thereof with the magnetic poles of said magnetic strip being positioned to deflect the magnetic field lines of said cylindrical magnet away from the sealing edge of said housing to prevent the escape of carrier granules from the chamber of said housing without the carrier granules adhering to said magnetic strip.

2. An apparatus according to claim 1, wherein said magnetic means includes another magnetic strip mounted on the other sealing edge of said housing.

* * * * *